US011308906B2

(12) United States Patent
Lei et al.

(10) Patent No.: US 11,308,906 B2
(45) Date of Patent: Apr. 19, 2022

(54) CIRCUIT FOR PROVIDING A TEMPERATURE-DEPENDENT COMMON ELECTRODE VOLTAGE

(71) Applicants: Chongqing BOE Optoelectronics Technology Co., Ltd., Chongqing (CN); BOE TECHNOLOGY GROUP CO., LTD., Beijing (CN)

(72) Inventors: Sijun Lei, Beijing (CN); Xu Lu, Beijing (CN); Shuai Hou, Beijing (CN); Siqing Fu, Beijing (CN); Yong Long, Beijing (CN); Ying Zhang, Beijing (CN); Shanbin Chen, Beijing (CN); Fanjian Zeng, Beijing (CN); Zhicai Xu, Beijing (CN); Sen Tan, Beijing (CN); Xinghong Liu, Beijing (CN); Xiangchao Chen, Beijing (CN); Yunsong Li, Beijing (CN); Xin Chen, Beijing (CN); Yuxu Geng, Beijing (CN)

(73) Assignees: Chongqing BOE Optoelectronics Technology Co., Ltd., Chongqing (CN); BOE Technology Group Co., Ltd., Beijing (CN)

( * ) Notice: Subject to any disclaimer, the term of this patent is extended or adjusted under 35 U.S.C. 154(b) by 422 days.

(21) Appl. No.: 16/345,707

(22) PCT Filed: Jun. 12, 2018

(86) PCT No.: PCT/CN2018/090846

§ 371 (c)(1),
(2) Date: Apr. 27, 2019

(87) PCT Pub. No.: WO2019/237247

PCT Pub. Date: Dec. 19, 2019

(65) Prior Publication Data

US 2021/0327381 A1 Oct. 21, 2021

(51) Int. Cl.
*G09G 3/36* (2006.01)

(52) U.S. Cl.
CPC ..... *G09G 3/3655* (2013.01); *G09G 3/3607* (2013.01); *G09G 2320/0257* (2013.01);
(Continued)

(58) Field of Classification Search
CPC ..... G09G 3/3655; G09G 3/3607; G09G 2320/0257; G09G 2320/041; G09G 2320/0693
See application file for complete search history.

(56) References Cited

U.S. PATENT DOCUMENTS 6,795,052 B2 * 9/2004 Lin ..... G09G 3/3696 323/313
9,389,621 B2 * 7/2016 Lee ..... G05F 1/461
(Continued)

FOREIGN PATENT DOCUMENTS

CN 1779591 A 5/2006
CN 102222485 A 10/2011
(Continued)

OTHER PUBLICATIONS

International Search Report & Written Opinion dated Feb. 20, 2019, regarding PCT/CN2018/090846.
(Continued)

*Primary Examiner* — Michael J Jansen, II
(74) *Attorney, Agent, or Firm* — Intellectual Valley Law, P.C.

(57) ABSTRACT

The present application discloses a circuit for providing a temperature-dependent common electrode voltage. The circuit includes a sensing sub-circuit coupled between a power-supply terminal and a ground terminal and configured to generate a first voltage for controlling a switching sub-circuit to connect the power-supply terminal to a first node.
(Continued)

The circuit further includes a compensation sub-circuit coupled between the first node and the ground terminal and be enabled, when the first voltage decreases below a threshold as temperature increases above a threshold temperature, to output a temperature-dependent second voltage proportional to the temperature to a second node. Additionally, the circuit includes an output sub-circuit coupled to the second node combined with a first input-voltage terminal and further coupled to a second input-voltage terminal, to generate a temperature-dependent output voltage based on a weighted mixing of the temperature-dependent second voltage, a first input voltage, and a second input voltage.

19 Claims, 5 Drawing Sheets

(52) U.S. Cl.
CPC ..... *G09G 2320/041* (2013.01); *G09G 2320/0693* (2013.01)

(56) References Cited

U.S. PATENT DOCUMENTS

| | | | | |
|---|---|---|---|---|
| 9,390,671 | B2 * | 7/2016 | Min | G09G 3/3648 |
| 9,647,661 | B2 * | 5/2017 | Cui | G09G 3/3696 |
| 9,666,135 | B2 * | 5/2017 | Koo | G09G 3/3266 |
| 10,424,264 | B2 * | 9/2019 | Na | H01L 35/30 |
| 10,867,573 | B2 * | 12/2020 | Liu | G09G 3/3655 |
| 10,916,209 | B2 * | 2/2021 | Wang | G09G 3/3655 |
| 10,964,286 | B2 * | 3/2021 | Li | G09G 3/3648 |
| 2002/0105494 | A1 * | 8/2002 | Lin | G09G 3/3696 345/101 |
| 2008/0111773 | A1 * | 5/2008 | Tsuge | G09G 3/3241 345/76 |
| 2008/0158119 | A1 | 7/2008 | Park et al. | |
| 2013/0314393 | A1 * | 11/2013 | Min | G09G 3/3655 345/212 |
| 2014/0104324 | A1 * | 4/2014 | Park | G09G 3/3648 345/690 |
| 2015/0115826 | A1 * | 4/2015 | Koo | G09G 3/3266 315/210 |
| 2015/0185744 | A1 * | 7/2015 | Lee | G05F 1/461 330/260 |
| 2016/0149574 | A1 * | 5/2016 | Cui | G09G 3/3696 327/513 |
| 2016/0247435 | A1 | 8/2016 | Park et al. | |
| 2016/0358579 | A1 | 12/2016 | Wang et al. | |
| 2018/0158429 | A1 * | 6/2018 | Na | G09G 3/3688 |
| 2018/0286336 | A1 * | 10/2018 | Wang | G09G 3/3655 |
| 2019/0355322 | A1 * | 11/2019 | Liu | G09G 3/3655 |
| 2020/0066221 | A9 * | 2/2020 | Wang | G09G 3/3696 |
| 2020/0098328 | A1 * | 3/2020 | Li | G09G 3/3696 |
| 2020/0342828 | A9 * | 10/2020 | Liu | G09G 3/3655 |

FOREIGN PATENT DOCUMENTS

| | | | |
|---|---|---|---|
| CN | 203456073 | U | 2/2014 |
| CN | 104460076 | A | 3/2015 |
| CN | 105096880 | A | 11/2015 |
| CN | 105867511 | A | 8/2016 |
| CN | 106847212 | A | 6/2017 |
| CN | 206640107 | U | 11/2017 |
| KR | 20070071255 | A | 7/2007 |

OTHER PUBLICATIONS

First Office Action in the Chinese Patent Application No. 201880000646.6, dated Mar. 25, 2021; English translation attached.

* cited by examiner

CIRCUIT FOR PROVIDING A TEMPERATURE-DEPENDENT COMMON ELECTRODE VOLTAGE

CROSS-REFERENCE TO RELATED APPLICATION

This application is a national stage application under 35 U.S.C. § 371 of International Application No. PCT/CN2018/090846, filed Jun. 12, 2019, the contents of which are incorporated by reference in the entirety.

TECHNICAL FIELD

The present invention relates to display technology, more particularly, to a circuit for providing temperature-dependent common electrode voltage, and a display apparatus having the same.

BACKGROUND

Due to temperature-dependent drift of thin-film transistor (TFT) properties such as charge mobility in TFT liquid-crystal display (TFT LCD) panel operating inn high temperature condition, much more ion impurities are cumulated in the liquid crystal layer as the temperature increases. These ion impurities induce an effective voltage posted at a common backplane node of the TFT LCD display panel. The effective voltage disturbs pixel driving signals. Additionally, the DC components of the ion impurity voltage directly cause a directional drift of the ion impurities as the temperature increases, resulting in so-called image sticking effect of the TFT LCD at high temperature. Solution of minimizing the image sticking effect with improved circuit and method is desired.

SUMMARY

In an aspect, the present disclosure provides a circuit for providing a temperature-dependent common electrode voltage. The circuit includes a sensing sub-circuit coupled between a power-supply terminal and a ground terminal and configured to generate a first voltage. Additionally, the circuit includes a switching sub-circuit configured to connect the power-supply terminal to a first node under control of the first voltage. Furthermore, the circuit includes a compensation sub-circuit coupled between the first node and the ground terminal and been enabled, when the first voltage decreases below a threshold as temperature increases above a threshold temperature, to output a second voltage to a second node, the second voltage being proportional to the temperature. Moreover, the circuit includes an in sub-circuit coupled to the second node to receive the second voltage combined with a first input-voltage terminal supplying a first input voltage and filthier coupled to a second input-voltage terminal supplying a second input voltage, to generate a temperature-dependent output voltage based on a weighted mixing of the second voltage, the first input voltage, and the second input voltage.

Optionally, the sensing sub-circuit includes at least a temperature-sensitive resistor connected in sees via a joint node to a second resistor between the power-supply terminal and the ground terminal.

Optionally, the temperature-sensitive resistor is characterized by a positive temperature coefficient with increasing resistance as the temperature increases. The first voltage is provided at the joint node with a fraction of a power-supply voltage from the power-supply terminal. The fraction decreases as temperature increases up to a maximum operation temperature.

Optionally, the switching sub-circuit includes a p-channel MOS transistor having a gate electrode coupled to the joint node, a drain electrode coupled to the power-supply terminal to receive a positive voltage, and a source electrode coupled to the first node.

Optionally, the p-channel MOS transistor is switched to a conduction state when a difference between the first voltage and the power-supply voltage is equal to or smaller than a threshold voltage of the p-channel MS transistor.

Optionally, the compensation sub-circuit includes a first operational amplifier configured a linear state with a pair of put voltage ports respectively coupled to a third node and a fourth node and an output port coupled to the first node, wherein the third node and the fourth node are in a virtually short state. The compensation sub-circuit further includes a first MOS transistor having a drain electrode coupled to the first node, a gate electrode coupled to a first bias terminal, and a source electrode coupled to the third node. Additionally, the compensation sub-circuit includes a second MOS transistor having a drain electrode coupled to the first node, a gate electrode coupled to a second bias terminal, and a source electrode coupled to the fourth node. The compensation sub-circuit further includes a third resistor coupled to the fourth node. Furthermore, the compensation sub-circuit includes a third MOS transistor having a drain electrode coupled to the first node, a gate electrode coupled to the second bias terminal to receive a second bias voltage, and a source electrode coupled to the second node. The compensation sub-circuit further includes a fourth resistor coupled to the second node and the ground terminal. The compensation sub-circuit also includes a first bipolar transistor having a collector electrode and a base electrode commonly coupled to the third node, and an emitter electrode coupled to the ground terminal, wherein the first bipolar transistor is characterized by a first saturation current. Moreover, the compensation sub-circuit includes a second bipolar transistor having a collector electrode and a base electrode commonly coupled to the third resistor, and an emitter electrode coupled to the ground terminal. The second bipolar transistor s characterized by a second saturation current equal to 1/n of the first saturation currant, n being a constant.

Optionally, the compensation sub-circuit is configured to yield a first current flawing through the third resistor and the second MOS transistor. The first current is equal to a voltage drop between the fourth node and the collector electrode of the second bipolar transistor divided by a resistance of the third resistor and the voltage drop is equal to a voltage difference of first base-emitter voltage of the first bipolar transistor and a second base-emitter voltage of the second bipolar transistor due to the virtual short state of the third node and the fourth node. The voltage drop is proportional to the temperature at least in a range from the threshold temperature to the maximum operation temperature.

Optionally, the compensation sub-circuit is configured to yield a second current flowing through the third MOS transistor and the fourth resistor. The second current is equal to the first current due to a common gate-drain voltage shared by the second MOS transistor and the third MOS transistor.

Optionally, the compensation sub-circuit is configured to output the second voltage at the second node. The second voltage is equal to a product of the voltage drop multiplying a ratio of a resistance of the fourth resistor over the resistance of the third resistor.

Optionally, the output sub-circuit includes a second operational amplifier configured as a summing amplifier having a first input port coupled to a first input-voltage terminal via a fifth resistor and the second node via a sixth resistor, a second input port coupled to a second input-voltage terminal via a seventh resistor and the ground terminal via an eighth resistor, and an output port looped back to the first input port via a ninth resistor. The temperature-dependent output voltage is outputted at the output port.

Optionally, the temperature-dependent output voltage is equal to the first input voltage with a first weighted factor plus the second voltage with a second weighted factor minus the second input voltage with a third weighted factor. The first weighted factor equals to a first ratio of a resistance of the ninth resistor over a resistance of the fifth resistor. The second weighted factor equals to a second ratio of the resistance of the ninth resistor over a resistance of the sixth resistor. The third weighted factor equals to a multiplication of a sum of 1, the first ratio, and the second ratio and a third ratio of a resistance of the eighth resistor over a sum of the resistance of the eighth resistor and a resistance of the seventh resistor.

In another aspect, the present disclosure provides a driving circuit for a display panel. The driving circuit includes a row of thin-film transistors respectively associated with one row of an array of subpixels and a common gate receiving a gate driving voltage for controlling the row of thin-film transistors. Each thin-film transistor receives a corresponding source voltage signal. The driving circuit further includes a row of effective capacitor groups respectively coupled to drain electrodes of the row of the thin-film transistors. Each effective capacitor group is associated with a liquid crystal layer per subpixel. Additionally, the driving circuit includes a common-voltage circuit for supplying a common electrode voltage to a common electrode of the effective capacitor groups. The common-voltage circuit is described herein.

Optionally, the sensing sub-circuit includes at least a temperature-sensitive resistor with a positive temperature coefficient connected in series via a joint node to a second resistor between the power-supply terminal supplying a power-supply voltage and the ground terminal, to provide the first voltage at the joint node with a fraction of the power-supply voltage. The fraction decreases as temperature increases up to a maximum operation temperature.

Optionally, the switching sub-circuit incudes a p-channel MOS transistor having a gate electrode coupled to the joint node, a drain electrode coupled to the power-supply terminal to receive a positive voltage, and a source electrode coupled to the first node. The p-channel MOS transistor is switched to a conduction state when a difference between the first voltage and the power-supply voltage is equal to or smaller than a threshold voltage of the p-channel MOS transistor.

Optionally, the compensation sub-circuit includes a first operational amplifier configured in a linear state with a pair of input voltage ports respectively coupled to a third node and a fourth node and an output port coupled to the first node, wherein the third node and the fourth node are in a virtually short state. The compensation sub-circuit further includes a first MOS transistor having a drain electrode coupled to the first node, a gate electrode coupled to a first bias terminal, and a source electrode coupled to the third node. Additionally, the compensation sub-circuit includes a second MOS transistor having a drain electrode coupled to the first node, a gate electrode coupled to a second bias terminal, and a source electrode coupled to the fourth node. The compensation sub-circuit further includes a third resistor coupled to the fourth node. Furthermore, the compensation sub-circuit includes a third MOS transistor having a drain electrode coupled to the first node, a gate electrode coupled to the second bias terminal to receive a second bias voltage, and a source electrode coupled to the second node. The compensation sub-circuit further includes a fourth resistor coupled to the second node and the ground terminal. The compensation sub-circuit also includes a first bipolar transistor having a collector electrode and a base electrode commonly coupled to t third node, and an emitter electrode coupled to the ground terminal, wherein the first bipolar transistor is characterized by a first saturation current. Moreover, the compensation sub-circuit includes a second bipolar transistor having a collector electrode and a gate electrode commonly coupled to the third resistor, and an emitter electrode coupled to the ground terminal. The second bipolar transistor is characterized by a second saturation current equal to 1/n of the first saturation current. Here n is a constant.

Optionally, the compensation sub-circuit is configured to yield a first current flowing through the third resistor and the second MOS transistor. The first current is proportional to the temperature at least in a range from the threshold temperature to the maximum operation temperature.

Optionally, the compensation sub-circuit is further configured to yield a second caret flowing through the third MOS transistor and the fourth resistor, wherein the second current is equal to the first current due to a common gate-drain voltage shared by the second MOS transistor and the third MOS transistor. The second current results in de second voltage at the second node to be proportional to the temperature up to the maximum operation temperature.

Optionally, the output sub-circuit includes a second operational amplifier configured as a summing amplifier having a first input port coupled to a first input-voltage terminal via a fifth resistor and the second node via a sixth resistor, a second input port coupled to a second input-voltage terminal via a seventh resistor and the ground terminal via an eighth resistor, and an output port looped back to the first input port via a ninth resistor. The temperature-dependent output voltage is outputted at the output port.

Optionally the temperature-dependent output voltage is equal to the first input voltage with a first weighted factor plus the second voltage with a second weighted factor minus the second input voltage with a third weighted factor. The first weighted factor equals to a first ratio of a resistance of the ninth resistor over a resistance of the fifth resistor. The second weighted factor equals to a second ratio of the resistance of the ninth resistor over a resistance of the sixth resistor. The third weighted factor equals to a multiplication of a sum of 1, the first ratio, and the second ratio and a third ratio of a resistance of the eighth resistor over a sum of the resistance of the eighth resistor and a resistance of the seventh resistor.

Optionally, the driving circuit further includes a buffer sub-circuit to output the temperature-dependent output voltage as a common electrode voltage applied to the common electrode to substantially minimize an effective voltage induced by ion impurities as temperature increases above the threshold temperature up to a maximum operation temperature.

In yet another aspect, the present disclosure provides a display panel including the driving circuit described herein.

In still another aspect, the present disclosure provides a method for compensating temperature-dependent ion-impurity-induced effective voltage on a common electrode of a display panel. The method includes generating a temperature sense voltage inversely related to a temperature in the display panel. The method further includes generating a temperature-dependent voltage upon the temperature sense voltage being below a threshold value. The temperature-dependent voltage increases as the temperature increases. Additionally, the method includes mixing the temperature-dependent voltage with fixed input voltages under respective weighted factors to output a temperature-dependent common electrode voltage. Furthermore, the method includes outputting the temperature-dependent common electrode voltage to the common electrode of the display panel.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

For driving a TFT LCD display configured as an array of subpixels, a conventional driving method is to provide a gate driving voltage signal to a Gate line connected commonly to gates of a row of thin-film transistors (TFTs) associated with a row of the array of subpixels to control switching an or off of the TFTs. Additionally, the driving method is to provide a source driving voltage signal to a common Source lime of a column of TFTs associated with a column of the array of subpixels to define image intensity for corresponding subpixels. Further, the TFT LCD display includes a common backplane node to provide a common electrode voltage as a reference voltage base for determining different electric field strength across a liquid crystal layer at each subpixel point by different Source line voltages.

Figure 1:
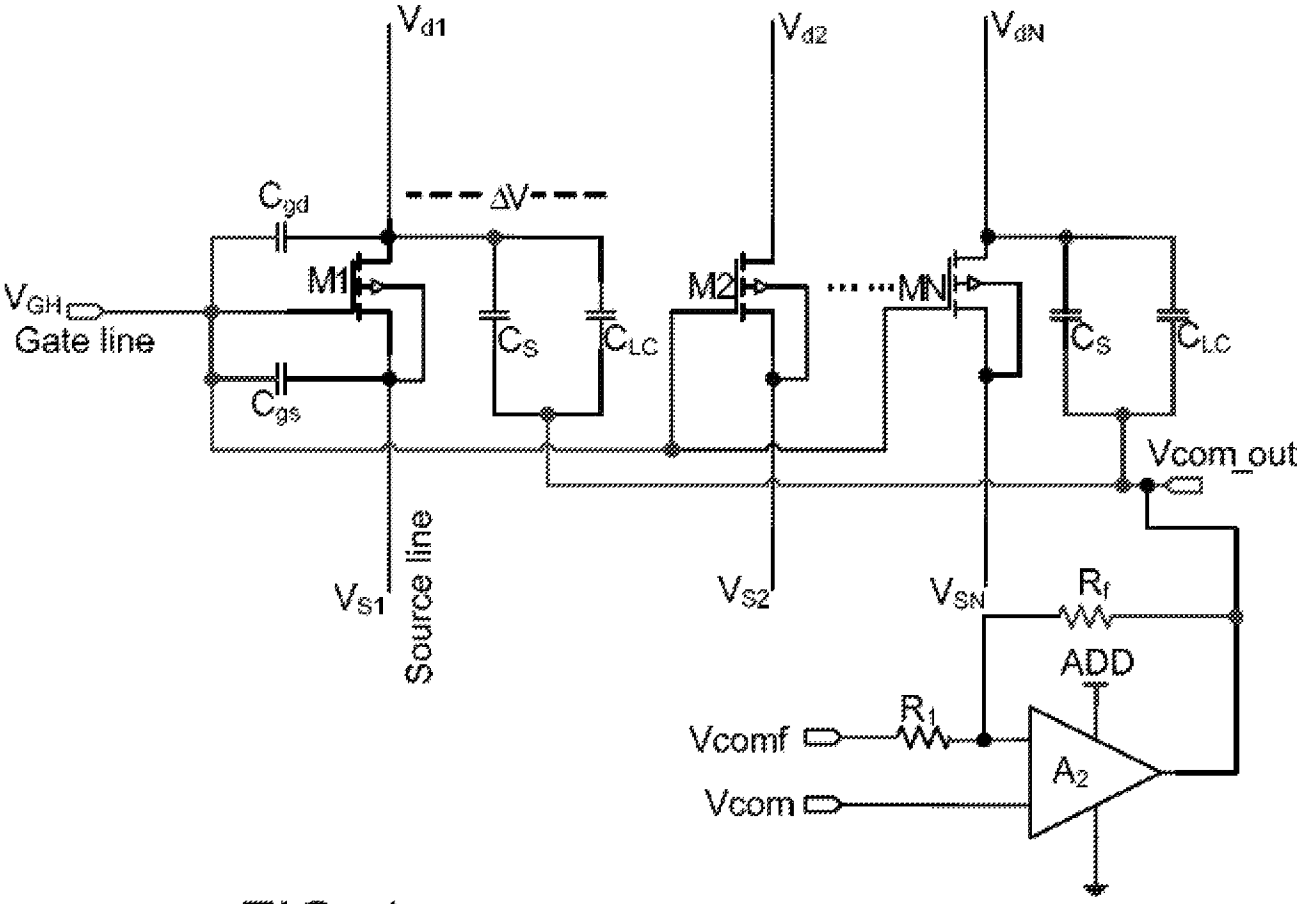
FIG. 1 is a conventional TFT LCD driving circuit receiving a fixed c n electrode voltage at high temperature.

FIG. 1 shows a conventional TFT LCD driving circuit. Referring to FIG. 1, a common electrode voltage $V_{com_out}$ is provided by a common voltage sub-circuit to a co n backplane node of a row of pixel-transistors (M1 through MN) of TFT LCD display and a gate driving signal $V_{GH}$ has been applied commonly to a Gate line connected to al gates of the row of pixel transistors. Each pixel transistor is respectively coupled to a Source line to provide image signal (in terms of source lines voltage, such as $V_{s1}$, or drain line voltage $V_{d1}$).

The common voltage sub-circuit includes an operational amplifier $A_2$ configured as a shimming amplifier. The operational amplifier $A_2$ includes a pair of input ports respectively coupled to two input-voltage terminals to receive two input voltages, $V_{com}$ and $V_{comf}$, and an output port to output an output voltage $V_{com_out}$ as a weighted mixing of the two input voltages, $V_{com}$ and $V_{comf}$. Since the two input voltages are substantially feed without a high-temperature sensing function or an auto-calibration function to compensate any change of the tempera tore, the common electrode voltage $V_{com_out}$ cannot respond to the increasing ion impurities (in terms of an effective capacitance Cs) due to increasing temperature and the corresponding effective voltage ΔV across liquid crystal layer (in terms of an effective capacitance $C_{LC}$), thereby unable to deal with image stick problem of TFT LCD display operated at high temperature range.

Accordingly, the present disclosure provides, inter (dim, a circuit configured to provide a temperature-dependent voltage to the common electrode associated with a TFT LCD display panel, a TFT LCD driving circuit, and a display apparatus having the same that substantially obviate one of more of the problems due to limitations and disadvantages of the related art. In one aspect, the present disclosure provides a circuit for providing a temperature-dependent common electrode voltage.

Figure 2:
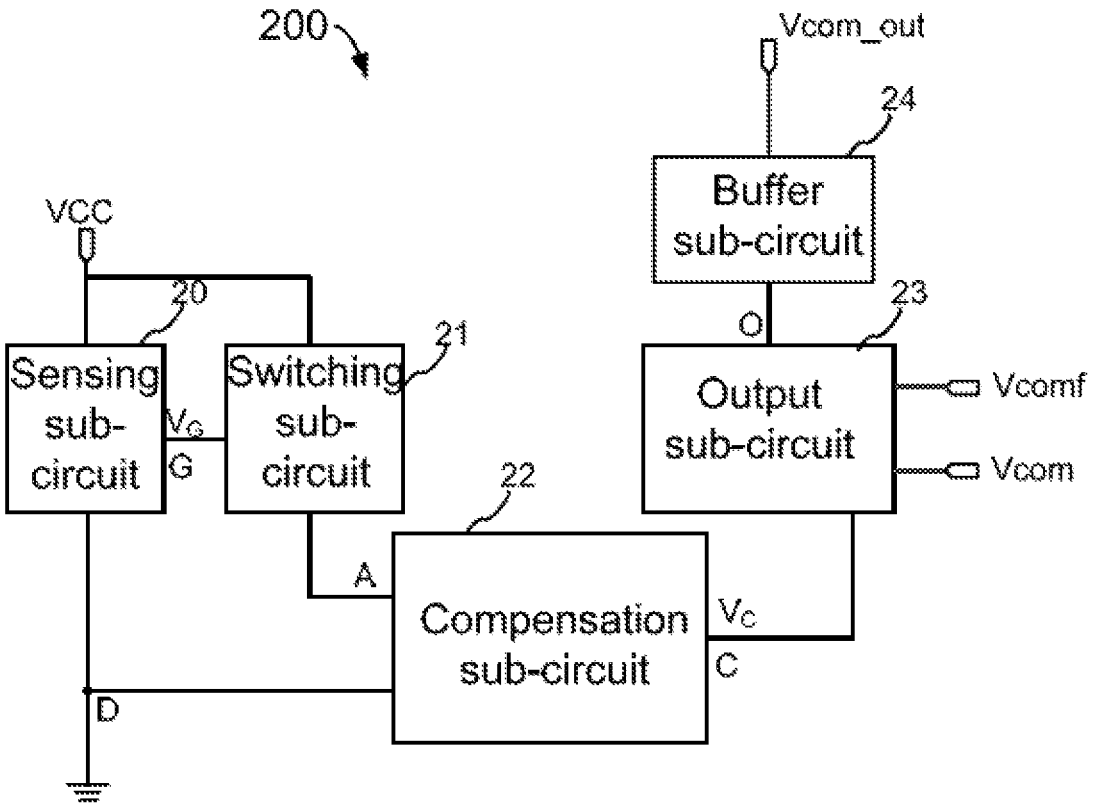
FIG. 2 is a circuit for providing a temperature-dependent common electrode voltage according to some embodiments of the present disclosure.

FIG. 2 shows a circuit 200 for providing a temperature-dependent common electrode voltage according to some embodiments of the present disclosure. Referring to FIG. 2, tire circuit 200 includes a sensing sub-circuit 20 coupled between a power-supply terminal VCC (supplying a power-supply voltage VCC) and a ground terminal D, a switching sub-circuit 21 coupled to the power-supply terminal, connected to the sensing sub-circuit 20 via joint node G, and also connected to a first node A. The sensing sub-circuit 20 is configured to sense a temperature change, particularly, an increase of temperature over a threshold temperature up to a maximum temperature, to provide a temperature-dependent first voltage $V_G$ to the joist node G. The switching sub-circuit 21 is configured as a switch that is controlled by the first voltage $V_G$ to be turned on as off. In particular, the switching sub-circuit 21 is fumed on when the first voltage $V_G$ is reduced to below a threshold value when the temperature is increased to above the threshold temperature.

The circuit 200 further includes a compensation sub-circuit 22 coupled to the first node A, the ground terminal D, and a second node C. The compensation sub-circuit 22 is configured to be enabled when the switching sub-circuit 21 is turned on to generate a temperature-dependent second voltage $V_C$ at a second node C. Additionally, the circuit 200 includes an output sub-circuit 23 coupled to the second node C to receive the second voltage $V_C$ and coupled to a first input voltage terminal $V_{com}$ and a second input voltage terminal $V_{comf}$ to output a temperature-dependent output voltage to an output node O. The first input voltage terminal $V_{com}$ is supplied with a fixed first input voltage $V_{com}$. The second input voltage terminal $V_{comf}$ is supplied with a fixed second input voltage $V_{comf}$.

Optionally, the circuit 200 includes a buffer sub-circuit 24 configured to output a common electrode voltage $V_{com_out}$ to a common electrode. Optionally, the c n electrode is a backplane node of liquid crystal box of a TFT LCD display panel. The common electrode voltage is substantially the same as the temperature-dependent output voltage at the output node O.

Figure 3:
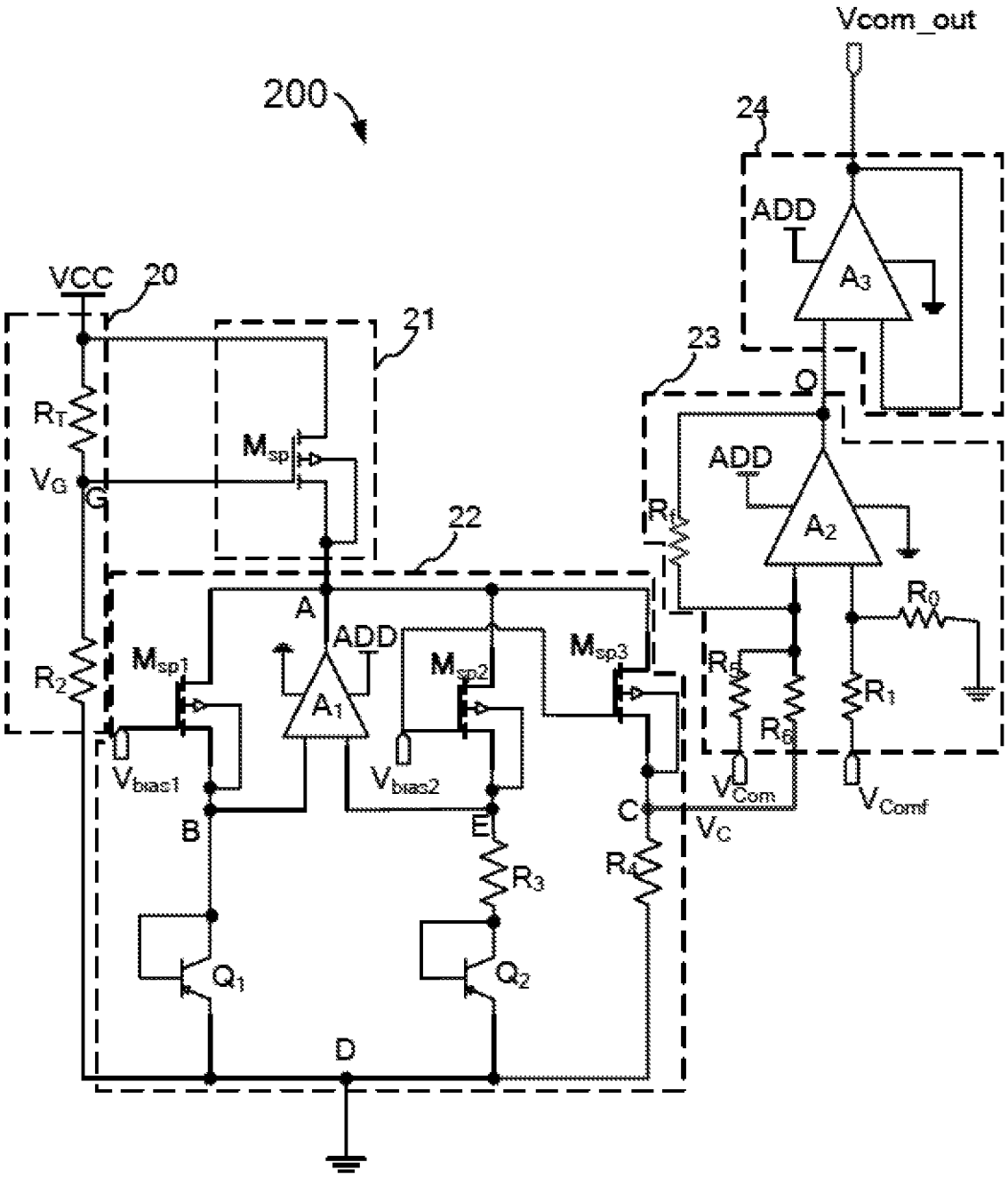
FIG. 3 is a circuit for providing a temperature-dependent common electrode voltage according to a specific embodiment of the present disclosure.

FIG. 3 is a circuit for providing a temperature-dependent common electrode voltage according to a specific embodiment of the present disclosure. Referring to FIG. 3, the sensing sub-circuit 20 includes a temperature-sensitive resistor $R_T$ coupled electrically in series via a joint node G with a second resistor $R_2$ between the power-supply terminal VCC and the ground terminal D. Optionally, the temperature-sensitive resistor $R_T$ is characterized by a positive temperature coefficient, i.e., with increasing resistance value as temperature T increases. Assuming that the power-supply voltage is supplied with a positive voltage VCC and the ground terminal D is set to 0 in voltage level, the voltage level at the joint node G will be given as a first voltage $V_G=VCC\times R_2(R_2+R_T)$. Since $R_T$ increases as the temperature T increases, the first voltage $V_G$ at the joint node G decreases.

Referring to FIG. 3, the switching sub-circuit 21 is provided as a p-channel metal-oxide-semiconductor (MOS) transistor. The PMOS transistor $M_{sp}$ has a gate electrode coupled to the joint node G to receive the first voltage $V_G$. The first voltage $V_G$ acts as a control voltage to control on or off of the PMOS transistor $M_{sp}$. The PMOS transistor $M_{sp}$ also has a drain electrode coupled to the power-supply terminal and a source node coupled to a first node A. As temperature increases to surpass a threshold temperature, the first voltage $V_G$ at the gate electrode of the PMOS transistor $M_{sp}$ decreases to below a threshold voltage, $VCC-V_{th}$, where $V_{th}$ is a fundamental transistor threshold voltage of the PMOS transistor $M_{sp}$. Under this condition, the PMOS transistor $M_{sp}$ is turned on to make it a conductor connected between the drain electrode (coupled to the power-supply terminal) and the source electrode to make the first node A to be at a same voltage level as the power-supply terminal, i.e., $V_A=VCC$.

In an embodiment the first node is provided with the voltage $V_A=VCC$ when the PMOS transistor $M_{sp}$ is turned on, which is effectively enabling a compensation sub-circuit 22 of the circuit 200. Referring to FIG. 3, the compensation sub-circuit 22 includes an operational amplifier $A_1$ configured as an open loop amplifier having a pair of differential input parts, third node B and fourth node E, being set to substantially the same voltage level, and an output port coupled to the first node A. The operational amplifier $A_1$ is biased with one positive voltage ADD at one electrode and a ground level at another electrode. The compensation sub-circuit 22 further includes three MOS transistors. A first MOS transistor $M_{sp1}$ has a gate electrode coupled to a first bias voltage terminal supplying a first bias voltage $V_{bias1}$. $M_{sp1}$ also has a drain electrode coupled to the first node A and a source electrode coupled to the third node B. The second MOS transistor $M_{sp2}$ and the third MOS transistor $M_{sp3}$ commonly have their gate electrodes coupled to a second bias voltage terminal supplying a second bias voltage $V_{bias2}$. Additionally. $M_{sp2}$ and $M_{sp3}$ commonly have their drain electrodes coupled to the first node A. $M_{sp2}$ also has a source electrode coupled to the fourth node E. $M_{sp3}$ has a source electrode coupled to the second node C. Furthermore, the compensation sub-circuit 22 includes a first bipolar transistor Q1 having a collector electrode and a base electrode commonly coupled to the third node B and an emitter electrode coupled to the ground terminal D. The compensation sub-circuit 22 also includes a third transistor $R_3$ coupled to the fourth node E. Moreover, the compensation sub-circuit 22 includes a second bipolar transistor $Q_2$ having a collector electrode and a base electrode commonly coupled to the third resistor $R_3$ and an emitter electrode coupled to the ground terminal D. The compensation sub-circuit 22 yet includes a fourth resistor $R_4$ coupled between the second node C and the ground terminal D. In an embodiment, the compensation sub-circuit 22 at an enabled state is configured to output a temperature-dependent voltage to the second node C.

Alternatively, if the PMOS transistor $M_{sp}$ is not tuned on, there is no positive voltage at the first node A and the compensation sub-circuit 22 is disabled, thereby providing no output at the second node C.

Referring to FIG. 3 again for the enabled compensation sub-circuit 22, since the first operational amplifier $A_1$ is operated at virtual short condition so that the voltage levels of the two different input parts are substantially the same, i.e., V3=V4, relative to the ground terminal D. Also because of the base electrode and the collector electrode of the first bipolar transistor $Q_1$ are connected to each other, V3 is basically a base-emitter voltage $V_{BE1}$ of $Q_1$. Similarly, the base electrode and the collector electrode of the second bipolar transistor $Q_2$ are connected together. Then, V4 is a base-emitter voltage $V_{BE2}=_2$ of $Q_2$ plus a voltage drop on the third resistor $R_3$, $V4=V_{BE2}+I_{R3}\cdot R_3$. This leads to a first current $I_{R3}$ flowing through the third resistor $R_3$ to be expressed as $$I_{R3}=(V_{BE2}-V_{BE1})/R_3 \tag{1}$$

In an embodiment for each of the first bipolar transistor $Q_1$ and the second bipolar transistor $Q_2$, the base-emitter voltage $V_{BE}$ under a condition that a current I is flowing from emitter to collector can be expressed as $V\cdot\ln(I/I_S)$, where $V=K\cdot T/q$ proportional to temperature T and $I_S$ is a saturation current of the bipolar transistor. In an embodiment, the second bipolar transistor $Q_2$ can be selected to set its saturation current $I_{S2}$ to be n times of the saturation current $I_{S1}$, of the first bipolar transistor $Q_1$, where n is a constant. Therefore, $I_{R3}$ is expressed as $$I_{R3}=V\cdot\ln(n)/R_3 \tag{2}$$

which is also proportional to the temperature T. The first current $I_{R3}$ is also a current flowing through the second MOS transistor $M_{sp2}$ under control of a proper $V_{bias2}$ at the gate electrode of $M_{sp2}$.

Referring to FIG. 3 again, the second MOS transistor $M_{sp2}$ and the third MOS transistor $M_{sp3}$ have a same gate-drain voltage controlled by the second bias voltage $V_{bias2}$ at their gate electrodes and the voltage level at the first node A. Thus, a second current flowing through the third MOS transistor $M_{sp3}$ shall be the same as the first current $I_{R3}$ flowing through the second MOS transistor $M_{sp2}$. Based on the circuitry setup for the compensation sub-circuit 22 shown in FIG. 3, the second current is also flowing through the fourth transistor $R_4$ to the ground terminal D. Thus, the second current can be expressed as $I_{R4}=I_{R3}=V\cdot\ln(n)/R_3$. A second voltage $V_C$ then is established at the second node C relative to the ground terminal D. And, $V_C$ can be expressed as $I_{R4}\cdot R_4$, i.e., $$V_C=R_4\cdot V\cdot\ln(n)/R_3 \tag{3}$$

The second voltage $V_C$ is just a temperature, dent output voltage of the compensation sub-circuit 22. In particular, the output voltage $V_C$ is proportional to the temperature T.

Referring to FIG. 3, the circuit 200 also includes an output sub-circuit 23 configured to mix the temperature-dependent second voltage $V_C$ with two input voltages, $V_{com}$ and $V_{comf}$, respective supplied to two input voltage terminals to output an output voltage to be applied to a common electrode. In the embodiment, the output sub-circuit 23 is comprised of a second operational amplifier $A_2$ configured as a summing amplifier with a pair of input ports and one output port. A first input port is coupled via a fifth resistor $R_5$ to a first input-voltage port to receive a first input voltage $V_{com}$ and via a sixth resistor $R_6$ to the second node C to receive the second voltage $V_C$ from the compensation sub-circuit 22. A second input port is coupled via a seventh resistor $R_1$ to a second input voltage port to receive a second input voltage $V_{comf}$ and via an eighth resistor $R_0$ to the ground. The output port of $A_2$ is connected to an output node O. The second operational amplifier $A_2$ also includes a feedback loop connected from the output port to the first input port via a ninth resistor $R_f$. $A_2$ also is powered by a positive, power supply ADD at one electrode and is grounded at another electrode. As a functional result of the second operational amplifier $A_2$, the voltage at the output port $V_O$ can be expressed as a weighted mixing of the second voltage $V_C$ ($=R_4 \cdot V \cdot \ln(n)/R_3$), the first input voltage $V_{com}$, and the second input voltage $V_{comf}$:

$$V_O = V_{com} \cdot R_f/R_5 + V \cdot \ln(n) \cdot R_f \cdot R_4/(R_3 \cdot R_5) - V_{comf} \cdot (1 + R_f/R_5 + R_f/R_6) \cdot R_0/(R_0 + R_1) \quad (4)$$

Here, the $V_{com}$ and $V_{comf}$ can be fixed, but $V = K \cdot T/q$ is proportional to the temperature so that $V_O$ is a temperature-dependent voltage, thereby providing a tunable mechanism for compensating or at least minimizing any temperature related ion-impurity-induced effective voltage at the common electrode.

Optionally, the circuit 200 includes a buffer sub-circuit 24 configured to transfer the temperature dependent output voltage substantially unchanged to the common electrode. In the embodiment shown in FIG. 3, the buffer sub-circuit 24 includes a third operational amplifier $A_3$ configured as a unit gain voltage follower. One input port of the third operational amplifier $A_3$ is coupled to the output port of the second operational amplifier $A_2$. Another input port of $A_3$ is connected to the output port of $A_3$. The output port of $A_3$ is connected to the common electrode (of TFT LCD display) to output the common electrode voltage $V_{com_out}$ for supporting image display on the TFT LCD display. In other word, $$V_{com_out} = V_{com} \cdot R_f/R_5 + V \cdot \ln(n) \cdot R_f \cdot R_4/(R_3 \cdot R_6) - V_{comf} \cdot (1 + R_f/R_5 + R_f/R_6) \cdot R_0/(R_0 + R_1) \quad (5)$$

In formula (5), the term of $V \cdot \ln(n) \cdot R_f \cdot R_4/(R_3 \cdot R_6)$ is zero when the temperature is in a normal-temperature range (i.e., below the threshold temperature $T_{th}$) because the compensation sub-circuit 22 is not enabled. While as the temperature increases to surpass the threshold temperature $T_{th}$, the compensation sub-circuit 22 is enabled and the term of $V \cdot \ln(n) \cdot R_f \cdot R_4/(R_3 \cdot R_5)$ is in effect in formula (5) so that the common electrode voltage is a temperature-dependent voltage. If the resistance values of those resistors including at least $R_f$, $R_3$, $R_4$, and $R_5$ are properly selected, this temperature-dependent common electrode voltage can be utilized for compensating or at least minimizing ion-impurity-induced effective voltage accumulated in the liquid crystal layer. Optionally, though it is not shown explicitly in the FIG. 3, the common electrode is connected to a backplane node of liquid crystal box of the TFT LCD display panel. Additionally, the buffer sub-circuit 24 is able to filter current noise without affecting the temperature-dependent common electrode voltage being outputted to the backplane nude of the TFT LCD display panel.

Figure 4:
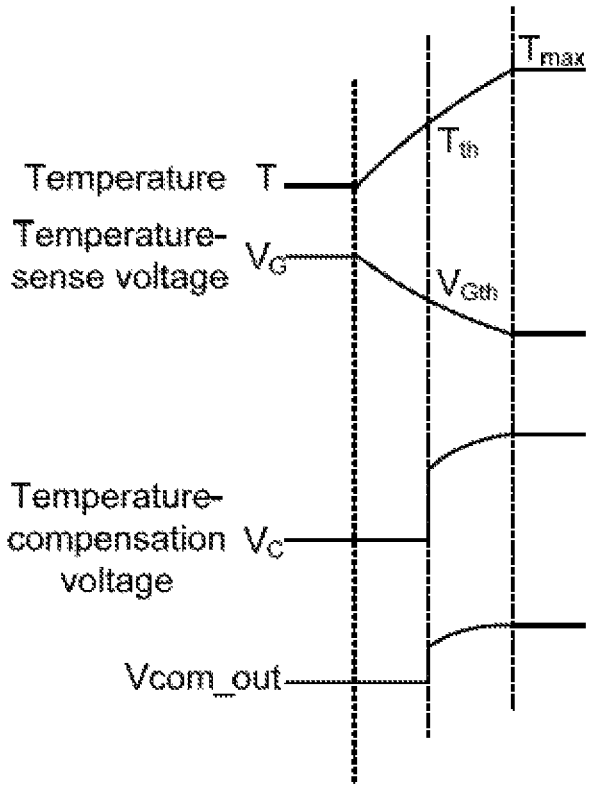
FIG. 4 is a timing diagram of generating a temperature-dependent common electrode voltage for compensating ion-impurity-induced effective voltage at a high-temperature range according to the embodiment of the present disclosure.

FIG. 4 is a timing diagram of generating a temperature-dependent common electrode voltage for compensating ion-impurity-induced effective voltage at a high temperature range according to the embodiment of the present disclosure. Referring to FIG. 4, the temperature (for operating a TFT LCD display) increases and surpasses a threshold temperature $T_{th}$ at a certain point. This threshold temperature $T_{th}$ is associated with a control voltage $V_G$ being reduced to a threshold $V_{Gth} = VCC - V_{th}$, here $V_{th}$ is a threshold voltage of a p-channel MOS transistor. The threshold temperature $T_{th}$ is a signal that the operation of the TFT LCD display enters a high-temperature range. Correspondingly the control voltage, threshold $V_{Gth}$ is to trigger the p-channel MOS transistor being turned on to enable a compensation sub-circuit to generate a temperature-dependent voltage $V_C$. In other words, before temperature T reaches $T_{th}$, $V_C$ is zero as the compensation sub-circuit is not enabled. After temperature T surpasses $T_{th}$ up to a maximum temperature $T_{max}$ (a designed temperature limit for operating the TFT LCD display), $V_C$ is generated and increases as temperature T increases up to $T_{max}$. Accordingly, a common electrode voltage $V_{com_out}$ is provided, partially based on the temperature-dependent voltage $V_C$, also as a temperature-dependent voltage up to $T_{max}$ to compensate the ion-impurity-induced effective voltage at the common electrode (i.e., common backplane node) of the TFT LCD display. This temperature-dependent common electrode voltage $V_{com_out}$ is able, with proper selection of resistance values for different resistors in the circuit, to compensate, eliminate, or at least minimize the effective voltage induced by ion impurities inside the liquid crystal layer in a high-temperature range above the threshold temperature up to a maximum temperature limit for operating the TFT LCD display.

In another aspect, the present disclosure provides a method for compensating temperature-dependent ion-impurity-induced effective voltage on a common electrode of pixels of TFT LCD display. The method includes generating a temperature sense voltage, which decreases as temperature increases. Further, the method includes setting a switching transistor to be turned on when die temperature sense voltage is below a threshold to enable a compensation sub-circuit to generate a temperature-dependent voltage $V_C$, which increases as the temperature increases. Additionally, the method includes using a summing operational amplifier to mix the temperature-dependent voltage $V_C$ with fixed input voltages under respective weighted factors to output a temperature-dependent common electrode voltage applied to the common electrode of pixels. The respective weighted factors are tunable by properly selecting different resistance values of various resistors in the compensation sub-circuit and the summing operational amplifier so that the effective voltage induced by ion impurities in the liquid crystal layer due to rising temperature can be minimized or even eliminated automatically.

Figure 5:
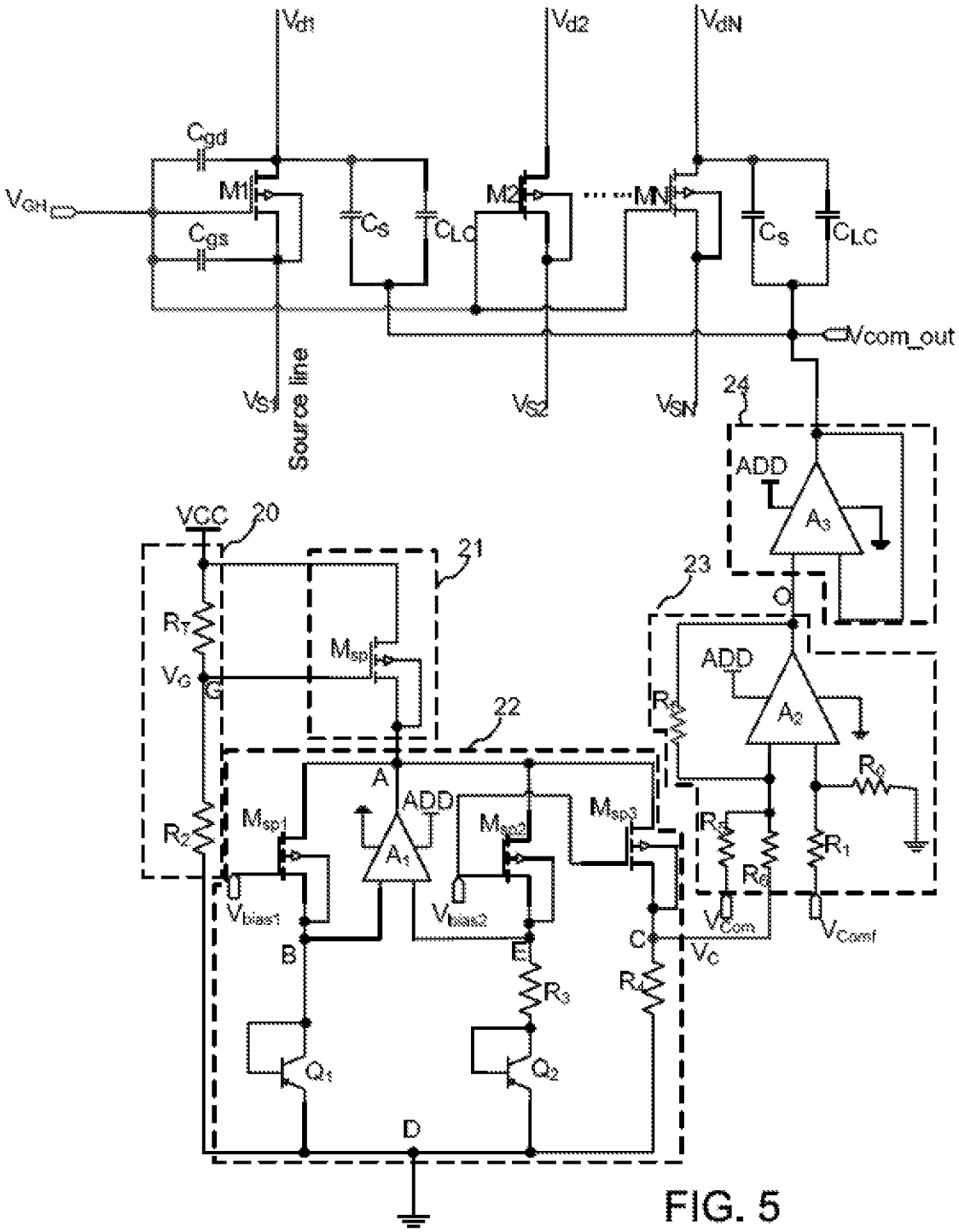
FIG. 5 is a driving circuit for operating a LCD display panel comprising a circuit of FIG. 3 to provide a temperature-dependent common electrode voltage according to an embodiment of the present disclosure.

In yet another aspect, the present disclosure provides a driving circuit for operating a LCD display panel. FIG. 5 is a driving circuit for operating, a LCD display panel comprising a circuit of FIG. 3 to provide a temperature-dependent common electrode voltage, according to an embodiment of the present disclosure. Referring to FIG. 5, the driving circuit includes a row of thin-film transistors (TFTs) respectively associated with one row of an array of subpixels of the LCD display panel. As seen, the row of TFTs includes N number of transistors, M1, M2, . . . , and MN, respectively associated with a row of N subpixels. The subpixel can be designed for producing one color light selected from red light, blue light, or green light with proper color filter being setup in the LCD display panel. Further, the driving circuit includes a common gate receiving a gate driving voltage $V_{GH}$ for controlling the row of the thin-film transistors, M1, M2, . . . , and MN. Here, each TFT receives a corresponding source voltage signal for yielding different image intensity of the corresponding subpixel. Additionally, the driving circuit includes a row of effective capacitor groups respectively coupled to drain electrodes of the row of the thin-film transistors. Each effective capacitor pow is associated with a liquid crystal layer per subpixel in the LCD display panel. In a specific embodiment, each effective capacitor group includes an effective liquid-crystal layer capacitor $C_{LC}$ and an effective ion-impurity capacitor Cs coupled in parallel between a drain electrode of the corresponding TFT and a common electrode. The capacitance of the effective capacitor group determines an electric field across the liquid crystal layer which in turn determines a tilt angle of each liquid crystal molecule per subpixel for deter g light intensity through the subpixel of the LCD display panel.

In the embodiment, the driving circuit further includes a common-voltage circuit for supplying a common electrode voltage, to the common electrode of the effective capacitor groups to set a voltage base for a source voltage applied to the source line of each TFT for determining the electric field across the liquid crystal layer. The common-voltage circuit includes a sensing sub-circuit coupled between a power-supply terminal and a ground terminal and configured to generate a first voltage. Additionally, the common-voltage circuit includes a switching sub-circuit configured to connect the power-supply terminal to a first node under control of the first voltage. The common-voltage circuit further includes a compensation sub-circuit coupled between the first node and the ground terminal and been enabled, when the first voltage decreases below a threshold as temperature increases above a threshold temperature, to output a second voltage to a second node, the second voltage being proportional to the temperature. Furthermore, the common-voltage circuit includes an output sub-circuit coupled to the second node to receive the second voltage combined with a first input-voltage terminal supplying a first input voltage and further coupled to a second input-voltage terminal supplying a second input voltage. The output sub-circuit is to generate a temperature-dependent output voltage based on a weighted mixing of the second voltage, the first input voltage, and the second input voltage.

Further, the driving circuit includes a buffer sub-circuit to output the temperature-dependent output voltage as a common elects ode voltage applied to the common electrode to substantially minimize an effective voltage induced by ion impurities as temperature increases above the threshold temperature up to the maximum temperature. Optionally, the effective voltage induced by ion impurities is a voltage associated with the effective impurity capacitor Cs per subpixel, which is increasing with increasing temperature at least in a range up to a maximum operation temperature. Optionally, the common-voltage circuit used in the driving circuit shown in FIG. 5 is substantially the circuit 200 shown in FIG. 3. In particular, the driving circuit is able to substantially compensate or at least minimize the effective voltage induced by ion impurities when the temperature increases to over a threshold temperature up to the maximum operation temperature of the LCD display panel.

In still another aspect, the present disclosure provides a liquid crystal display panel including the driving circuit described herein. The driving circuit is provided in FIG. 5. In particular, the LCD panel is able to be operated in a high-temperature range up to a maximum operation temperature during which the driving circuit is configured to substantially compensate or at least e the effective voltage induced by ion impurities.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention dos not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons stilled in the art without departing from the scope of the present invention as defined by the following claims. Moreover, no element and component in the present disclosure is intended to be dedicated to the public regardless of whether the element or component is explicitly recited in the following claims.

What is claimed is:

1. A circuit for providing a temperature-dependent common electrode voltage, the circuit comprising:

a sensing circuit coupled between a power-supply terminal and a ground terminal and configured to generate a first voltage;

a switching circuit configured to connect the power-supply terminal to a first node under control of the first voltage;

a compensation circuit coupled between the first node and the ground terminal and being enabled, when the first voltage decreases below a threshold as temperature increases above a threshold temperature, to output a second voltage to a second node, the second voltage being proportional to the temperature; and an output circuit coupled to the second node to receive the second voltage combined with a first input-voltage terminal supplying a first input voltage and further coupled to a second input-voltage terminal supplying a second input voltage, to generate a temperature-dependent output voltage based on a weighted mixing of the second voltage, the first input voltage, and the second input voltage.

2. The circuit of claim 1, wherein the sensing circuit comprises at least a temperature-sensitive resistor connected in series via a joint node to a second resistor between the power-supply terminal and the ground terminal.

3. The circuit of claim 2, wherein the temperature-sensitive resistor is characterized by a positive temperature coefficient with increasing resistance as the temperature increases, wherein the first voltage is provided at the joint node with a fraction of a power-supply voltage from the power-supply terminal, wherein the fraction decreases as temperature increases up to a maximum operation temperature.

4. The circuit of claim 3, wherein the switching circuit comprises a p-channel MOS transistor having a gate electrode coupled to the joint node, a drain electrode coupled to the power-supply terminal to receive a positive voltage, and a source electrode coupled to the first node.

5. The circuit of claim 1, wherein the compensation circuit comprises:

a first operational amplifier configured in a linear state with a pair of input voltage ports respectively coupled to a third node and a fourth node and an output port coupled to the first node, wherein the third node and the fourth node are in a virtually short state;

a first MOS transistor having a drain electrode coupled to the first node, a gate electrode coupled to a first bias terminal, and a source electrode coupled to the third node;

a second MOS transistor having a drain electrode coupled to the first node, a gate electrode coupled to a second bias terminal, and a source electrode coupled to the fourth node;

a third resistor coupled to the fourth node;

a third MOS transistor having a drain electrode coupled to the first node, a gate electrode coupled to the second bias terminal to receive a second bias voltage, and a source electrode coupled to the second node;

a fourth resistor coupled to the second node and the ground terminal;

a first bipolar transistor having a collector electrode and a base electrode commonly coupled to the third node, and an emitter electrode coupled to the ground terminal, wherein the first bipolar transistor is characterized by a first saturation current; and a second bipolar transistor having a collector electrode and a base electrode commonly coupled to the third resistor, and an emitter electrode coupled to the ground terminal, wherein the second bipolar transistor is characterized by a second saturation current equal to 1/n of the first saturation current, n being a constant.

6. The circuit of claim 5, wherein the compensation circuit is configured to yield a first current flowing through the third resistor and the second MOS transistor, wherein the first current is equal to a voltage drop between the fourth node and the collector electrode of the second bipolar transistor divided by a resistance of the third resistor and the voltage drop is equal to a voltage difference of a first base-emitter voltage of the first bipolar transistor and a second base-emitter voltage of the second bipolar transistor due to the virtual short state of the third node and the fourth node, wherein the voltage drop is proportional to the temperature at least in a range from the threshold temperature to the maximum operation temperature.

7. The circuit of claim 6, wherein the compensation circuit is configured to yield a second current flowing through the third MOS transistor and the fourth resistor, wherein the second current is equal to the first current due to a common gate-drain voltage shared by the second MOS transistor and the third MOS transistor.

8. The circuit of claim 7, wherein the compensation circuit is configured to output the second voltage at the second node, wherein the second voltage is equal to a product of the voltage drop multiplying a ratio of a resistance of the fourth resistor over the resistance of the third resistor.

9. The circuit of claim 1, wherein the output circuit comprises a second operational amplifier configured as a summing amplifier having a first input port coupled to a first input-voltage terminal via a fifth resistor and the second node via a sixth resistor, a second input port coupled to a second input-voltage terminal via a seventh resistor and the ground terminal via an eighth resistor, and an output port looped back to the first input port via a ninth resistor, wherein the temperature-dependent output voltage is outputted at the output port.

10. The circuit of claim 9, wherein the temperature-dependent output voltage is equal to the first input voltage with a first weighted factor plus the second voltage with a second weighted factor minus the second input voltage with a third weighted factor, wherein the first weighted factor equals to a first ratio of a resistance of the ninth resistor over a resistance of the fifth resistor, the second weighted factor equals to a second ratio of the resistance of the ninth resistor over a resistance of the sixth resistor, and the third weighted factor equals to a multiplication of a sum of 1, the first ratio, and the second ratio and a third ratio of a resistance of the eighth resistor over a sum of the resistance of the eighth resistor and a resistance of the seventh resistor.

11. A driving circuit for a display panel, comprising:

a row of thin-film transistors respectively associated with one row of an array of subpixels;

a common gate receiving a gate driving voltage for controlling the row of thin-film transistors, wherein each thin-film transistor receives a corresponding source voltage signal;

a row of effective capacitor groups respectively coupled to drain electrodes of the row of the thin-film transistors, each effective capacitor group being associated with a liquid crystal layer per subpixel; and a common-voltage circuit for supplying a common electrode voltage to a common electrode of the effective capacitor groups, wherein the common-voltage circuit comprises:

a sensing circuit coupled between a power-supply terminal and a ground terminal and configured to generate a first voltage;

a switching circuit configured to connect the power-supply terminal to a first node under control of the first voltage;

a compensation circuit coupled between the first node and the ground terminal and being enabled, when the first voltage decreases below a threshold as temperature increases above a threshold temperature, to output a second voltage to a second node, the second voltage being proportional to the temperature; and an output circuit coupled to the second node to receive the second voltage combined with a first input-voltage terminal supplying a first input voltage and further coupled to a second input-voltage terminal supplying a second input voltage, to generate a temperature-dependent output voltage based on a weighted mixing of the second voltage, the first input voltage, and the second input voltage.

12. The driving circuit of claim 11, wherein the sensing circuit comprises at least a temperature-sensitive resistor with a positive temperature coefficient connected in series via a joint node to a second resistor between the power-supply terminal supplying a power-supply voltage and the ground terminal, to provide the first voltage at the joint node with a fraction of the power-supply voltage, wherein the fraction decreases as temperature increases up to a maximum operation temperature.

13. The driving circuit of claim 12, wherein the switching circuit comprises a p-channel MOS transistor having a gate electrode coupled to the joint node, a drain electrode coupled to the power-supply terminal to receive a positive voltage, and a source electrode coupled to the first node, wherein the p-channel MOS transistor is switched to a conduction state when a difference between the first voltage and the power-supply voltage is equal to or smaller than a threshold voltage of the p-channel MOS transistor.

14. The driving circuit of claim 11, wherein the compensation circuit comprises:

a first operational amplifier configured in a linear state with a pair of input ports respectively coupled to a third node and a fourth node and an output port coupled to the first node, wherein the third node and the fourth node are in a virtually short state;

a first MOS transistor having a drain electrode coupled to the first node, a gate electrode coupled to a first bias terminal, and a source electrode coupled to the third node;

a second MOS transistor having a drain electrode coupled to the first node, a gate electrode coupled to a second bias terminal, and a source electrode coupled to the fourth node;

a third resistor coupled to the fourth node;

a third MOS transistor having a drain electrode coupled to the first node, a gate electrode coupled to the second bias terminal to receive a second bias voltage, and a source electrode coupled to the second node;

a fourth resistor coupled to the second node and the ground terminal;

a first bipolar transistor having a collector electrode and a base electrode commonly coupled to the third node, and an emitter electrode coupled to the ground terminal, wherein the first bipolar transistor is characterized by a first saturation current; and a second bipolar transistor having a collector electrode and a gate electrode commonly coupled to the third resistor, and an emitter electrode coupled to the ground terminal, wherein the second bipolar transistor is characterized by a second saturation current equal to 1/n of the first saturation current, n being a constant.

15. The driving circuit of claim 14, wherein the compensation circuit is configured to yield a first current flowing through the third resistor and the second MOS transistor, wherein the first current is proportional to the temperature at least in a range from the threshold temperature to the maximum operation temperature, and further configured to yield a second current flowing through the third MOS transistor and the fourth resistor, wherein the second current is equal to the first current due to a common gate-drain voltage shared by the second MOS transistor and the third MOS transistor, wherein the second current results in the second voltage at the second node to be proportional to the temperature up to the maximum operation temperature.

16. The driving circuit of claim 11, wherein the output circuit comprises a second operational amplifier configured as a summing amplifier having a first input port coupled to a first input-voltage terminal via a fifth resistor and the second node via a sixth resistor, a second input port coupled to a second input-voltage terminal via a seventh resistor and the ground terminal via an eighth resistor, and an output port looped back to the first input port via a ninth resistor, wherein the temperature-dependent output voltage is outputted at the output port.

17. The driving circuit of claim 16, wherein the temperature-dependent output voltage is equal to the first input voltage with a first weighted factor plus the second voltage with a second weighted factor minus the second input voltage with a third weighted factor, wherein the first weighted factor equals to a first ratio of a resistance of the ninth resistor over a resistance of the fifth resistor, the second weighted factor equals to a second ratio of the resistance of the ninth resistor over a resistance of the sixth resistor, and the third weighted factor equals to a multiplication of a sum of 1, the first ratio, and the second ratio and a third ratio of a resistance of the eighth resistor over a sum of the resistance of the eighth resistor and a resistance of the seventh resistor.

18. The driving circuit of claim 11, further comprising a buffer circuit to output the temperature-dependent output voltage as a common electrode voltage applied to the common electrode to substantially minimize an effective voltage induced by ion impurities as temperature increases above the threshold temperature up to a maximum operation temperature.

19. A display panel comprises the driving circuit of claim 11.

* * * * *